US009039108B2

(12) United States Patent
Feuerstein

(10) Patent No.: US 9,039,108 B2
(45) Date of Patent: May 26, 2015

(54) DRAWER FRAME HAVING A TILT ADJUSTMENT

(71) Applicant: Julius Blum GmbH, Hochst (AT)

(72) Inventor: Markus Feuerstein, Hochst (AT)

(73) Assignee: JULIUS BLUM GMBH, Hochst (AT)

( * ) Notice: Subject to any disclaimer, the term of this patent is extended or adjusted under 35 U.S.C. 154(b) by 0 days.

(21) Appl. No.: 14/028,948

(22) Filed: Sep. 17, 2013

(65) Prior Publication Data

US 2014/0015391 A1 Jan. 16, 2014

Related U.S. Application Data

(63) Continuation of application No. PCT/AT2012/000082, filed on Mar. 29, 2012.

(30) Foreign Application Priority Data

Apr. 19, 2011 (AT) ..... A 550/2011

(51) Int. Cl.
*A47B 88/00* (2006.01)
*A47B 88/18* (2006.01)
*A47B 88/04* (2006.01)

(52) U.S. Cl.
CPC ..... *A47B 88/18* (2013.01); *A47B 88/0055* (2013.01); *A47B 88/0422* (2013.01); *A47B 2210/0054* (2013.01); *A47B 2088/0037* (2013.01)

(58) Field of Classification Search
CPC ..... A47B 2210/0054; A47B 2088/0037
USPC ..... 312/334.4, 348.1, 348.2, 348.4, 263, 312/265.5
See application file for complete search history.

(56) References Cited

U.S. PATENT DOCUMENTS

| | | | | | |
|---|---|---|---|---|---|
| 4,042,288 | A | * | 8/1977 | Litchfield | 312/348.2 |
| 4,099,815 | A | * | 7/1978 | Cox et al. | 312/348.2 |
| 4,108,520 | A | * | 8/1978 | Litchfield | 312/348.2 |
| 4,874,212 | A | * | 10/1989 | Rock et al. | 312/330.1 |
| 5,439,283 | A | * | 8/1995 | Schroder et al. | 312/334.4 |
| 5,466,061 | A | * | 11/1995 | Lautenschlager | 312/348.2 |
| 5,664,855 | A | * | 9/1997 | Lautenschlager et al. | 312/334.4 |
| 5,664,857 | A | * | 9/1997 | Lautenschlager et al. | 312/348.4 |
| 5,860,718 | A | * | 1/1999 | Brustle | 312/348.2 |

(Continued)

FOREIGN PATENT DOCUMENTS

| | | |
|---|---|---|
| CN | 1310974 | 9/2001 |
| CN | 2781909 | 5/2006 |

(Continued)

OTHER PUBLICATIONS

International Search Report (ISR) issued Jun. 25, 2012 in International (PCT) Application No. PCT/AT2012/000082.

(Continued)

*Primary Examiner* — Hanh V Tran
(74) *Attorney, Agent, or Firm* — Wenderoth, Lind & Ponack, L.L.P.

(57) ABSTRACT

The invention relates to a drawer frame including an adjusting device for raising and lowering the drawer frame relative to a drawer pull-out guide. The adjusting device, which is arranged substantially inside the drawer frame, has an actuating element accessible from the drawer interior, in the region of a lateral inner surface of the drawer frame facing the drawer interior.

11 Claims, 17 Drawing Sheets

(56) References Cited

U.S. PATENT DOCUMENTS

| | | | | |
|---|---|---|---|---|
| 5,971,516 | A * | 10/1999 | Huber | 312/348.1 |
| 6,027,194 | A * | 2/2000 | Fleisch | 312/348.4 |
| 6,412,893 | B1 * | 7/2002 | Muterthies et al. | 312/348.1 |
| 6,457,791 | B1 * | 10/2002 | Muterthies et al. | 312/348.4 |
| 7,014,282 | B2 | 3/2006 | Hämmerle | |
| 7,055,919 | B2 * | 6/2006 | Lam Harn et al. | 312/348.4 |
| 7,226,139 | B2 * | 6/2007 | Salice | 312/334.4 |
| 7,455,374 | B2 * | 11/2008 | Nachbaur et al. | 312/330.1 |
| 7,857,404 | B2 * | 12/2010 | Lam et al. | 312/348.2 |
| 8,220,885 | B2 * | 7/2012 | Weber | 312/348.4 |
| 2001/0019235 | A1 * | 9/2001 | Hammerle | 312/334.4 |
| 2002/0158557 | A1 * | 10/2002 | Weichelt | 312/334.4 |
| 2004/0000852 | A1 * | 1/2004 | Lam Harn et al. | 312/348.4 |
| 2004/0119387 | A1 * | 6/2004 | Schwaerzler et al. | 312/334.4 |
| 2004/0239219 | A1 * | 12/2004 | Kim et al. | 312/334.4 |
| 2005/0017615 | A1 * | 1/2005 | Salice | 312/348.4 |
| 2007/0138924 | A1 * | 6/2007 | Lautenschlager | 312/348.2 |
| 2007/0228906 | A1 * | 10/2007 | Netzer | 312/348.4 |
| 2008/0247812 | A1 * | 10/2008 | Embacher | 403/231 |
| 2009/0091228 | A1 * | 4/2009 | Tupper et al. | 312/348.4 |
| 2009/0174299 | A1 * | 7/2009 | Lam et al. | 312/348.4 |
| 2010/0102692 | A1 * | 4/2010 | Hammerle | 312/348.4 |

FOREIGN PATENT DOCUMENTS

| | | | | |
|---|---|---|---|---|
| DE | 89 05 310 | | 6/1989 | |
| DE | 38 18 559 | | 12/1989 | |
| DE | 20 2007 016 720 | | 4/2008 | |
| DE | 20 2007 014 954 | | 12/2008 | |
| EP | 1 093 735 | | 4/2001 | |
| EP | 1 516 562 | | 3/2005 | |
| GB | 2182546 | A * | 5/1987 | A47B 88/00 |
| GB | 2 205 732 | | 12/1988 | |
| JP | 05007515 | A * | 1/1993 | A47B 88/00 |
| WO | 2009/056326 | | 5/2009 | |
| WO | 2010/100159 | | 9/2010 | |
| WO | 2011/124453 | | 10/2011 | |

OTHER PUBLICATIONS

Austrian Patent Office Search Report (ASR) issued Dec. 5, 2011 in Austrian Patent Application No. A 550/2011.

* cited by examiner

DRAWER FRAME HAVING A TILT ADJUSTMENT

BACKGROUND OF THE INVENTION

The invention concerns a drawer frame member having an adjusting device for raising and lowering the drawer frame member relative to a drawer extension guide (i.e., adjusting the height of the drawer frame member). The invention further concerns a drawer having such a drawer frame member as well as an arrangement with a drawer and a drawer extension guide. The invention further concerns an article of furniture having this arrangement.

Drawer frame members of that kind (corresponding to drawer side walls) serve to provide that the front panel is inclined by heightwise adjustment or raising and lowering of the drawer frame member. This therefore does not involve adjustment of the inclination of the front panel relative to a drawer, but rather the entire drawer or the drawer frame member is inclined, whereby the front panel fitted thereto is also inclined. Basically that adjustment in inclination serves in particular aesthetic purposes in order to achieve a regular appearance in respect of a plurality of drawer fronts in mutually superposed relationship or relative to the furniture carcass. That adjustment after fitting or when fitting the drawer is often necessary by virtue of the manufacturing tolerances of the many individual components.

An example of such inclination adjustment for the front panel by way of the drawer or the drawer side wall itself can be found in EP 1 516 562 B1. It will be noted however that a disadvantage with that adjustment option is that the adjusting screw is difficult to gain access thereto. This means that, in particular, when individual drawers are arranged in closely mutually superposed relationship, that adjusting screw which is only accessible from above can only be reached with very great difficulty.

SUMMARY OF THE INVENTION

The object of the present invention is therefore that of providing a drawer frame member or drawer side wall which is improved over the state of the art and in which inclination adjustment for the front panel or heightwise adjustment for the entire drawer frame member can be comfortably and readily achieved.

For a drawer frame member having the features of the classifying portion of the invention that is achieved in that in the region of the lateral inside surface of the drawer frame member, that faces in the direction of the drawer interior, the adjusting device arranged substantially in the interior of the drawer frame member has an actuating element accessible from the drawer interior. In that way, the entire drawer interior can be better used for actuation of the actuating element. In the actuating procedure, a fitter can get into the interior space in the drawer and can easily and comfortably reach the actuating element even when a drawer is only half opened or when drawers are disposed in closely mutually superposed relationship.

The drawer interior is generally viewed as being the space in which articles to be stowed are stored in the normal purpose of use. In other words, this means that this is the space which is delimited laterally by the drawer frame members, the front panel and the rear wall and downwardly by the drawer bottom. There is no space which can be used for stowage purposes above the lateral drawer frame members.

In principle, the lateral inside surface of the drawer frame member can assume any shape, but a usual variant is that in which the inside surface extends substantially vertically in the mounted position of the drawer frame member.

The possibility should not be excluded that the actuating element is in the form of a slider, but preferably the actuating element is rotatable. In that respect, particularly preferably the rotatable actuating element on its surface facing in the direction of the drawer interior has a recess, preferably a cross slot or a hexagonal socket, in which a tool can be fitted. In that way, the actuating element can be rotated with a suitable screw wrench.

In order in contrast thereto to permit actuation without a tool, the actuating element can have a knurling at the outside surface to facilitate rotation with the fingers.

A particularly preferred variant of this invention can provide that the adjusting device has a support foot which in the mounted position rests on the drawer extension guide and which is moveable linearly and vertically by actuation, preferably by rotation, of the actuating element. Thus, the drawer frame member has an extendable support foot which rests directly on the drawer extension guide, preferably on its drawer rail. That has the advantage in particular over EP 1 516 562 B1 of substantially better holding and supporting effects than by virtue of the narrow annular groove which is shown in that specification and into which a holding edge engages.

For converting the rotary movement of the actuating element into the translatory movement of the support foot, it is possible for example to provide a gear which forms the actuating element and a rack which forms the support foot. In order, however, to achieve a self-locking heightwise adjustment option, it is preferable that at its end remote from the drawer interior the actuating element has a spiral worm which is in engagement with a corresponding latching means on the support foot.

To make actuation of the actuating element as simple as possible, preferably the axis of rotation of the actuating element extends transversely relative to the substantially vertical orientation of the inside surface. It is particularly advantageous in that respect if the axis of rotation is at an angle of between 30° and 120° preferably between 40° and 95°, in relation to the vertical orientation of the inside surface. When using a tool therefore the tool can be fitted to the actuating element slightly inclinedly relative to the horizontal or also precisely in a horizontal (corresponding to 90°).

In principle, it is immaterial whether the adjusting device is arranged in a front region of the drawer frame member or in a rear region thereof as long as pivotal movement of the drawer about the resting point on the drawer extension guide is possible by virtue of adjustment of the adjusting device. As however complicated and expensive front panel fitments are often arranged in the front region of the drawer, preferably the drawer frame member is a U-shaped profile member and has a rear wall holder which can be connected to the U-shaped profile member for connecting the drawer frame member to a rear wall of a drawer, the adjusting device being part of the rear wall holder. In that way, the rear wall holder which is appropriate only for mounting the rear wall to the drawer frame member can additionally also adopt the function of providing for adjustment of inclination. In order to give good access for inclination adjustment to the rear wall holder which is mostly arranged in the drawer frame member, even in the mounted condition, preferably the U-shaped profile member also forms the inside surface of the drawer frame member and has a hole through which the actuating element of the adjusting device is accessible. That therefore also satisfies the aesthetic demands in the drawer interior.

The invention covers not just the drawer frame member alone but also a drawer having two drawer frame members forming the side walls of the drawer, a rear wall connected to the drawer frame members, a drawer bottom and a front panel which is or can be mounted to the drawer frame members and optionally two container rails. In that case, the two drawer frame members can be of a substantially mirror-symmetrical configuration and can have an actuating element at their respective inside surfaces facing in the direction of the internal space in the drawer.

Protection is also claimed for an arrangement comprising such a drawer and a drawer extension guide which can be mounted to an article of furniture. In that respect, particularly preferably the drawer extension guide has a carcass rail which can be mounted to a carcass of an article of furniture, optionally a central rail, and a drawer rail for connecting the drawer to the drawer extension guide. The support foot of the adjusting device is held in positionally fixed relationship to the drawer rail, preferably to a holding nose of the drawer rail. In that case, the drawer can be connected to the drawer extension guide by way of per se known latching means or snap-in elements. The term positionally fixed holding of the support foot to the drawer rail means that, upon heightwise or inclination adjustment, the support foot does not perform a relative movement with respect to the drawer extension guide (a relative movement upon removal of the entire drawer is in fact involved). Rather, in the adjustment procedure, a relative movement of all other components of the drawer frame member relative to the support foot and thus also relative to the drawer extension guide is performed. In principle, the possibility should also not be excluded in that respect that the support foot itself remains on the extension guide even in the removed condition of the drawer. In that respect however it is necessary to guarantee that simple re-fitting and exact engagement of the support foot into the actuating element of the adjusting device is possible. The drawer is always held in play-free manner to the drawer rail by the holding nose and can only be moved by the adjusting device or upon removal of the entire drawer, relative to the drawer rail.

The invention also relates to an article of furniture having a furniture carcass, a drawer extension guide mounted to the furniture carcass, and a drawer fitted to the extension guide, with a drawer frame member according to the invention.

BRIEF DESCRIPTION OF THE DRAWINGS

Further details and advantages of the present invention are described more fully hereinafter by means of the specific description with reference to the embodiment by way of example illustrated in the drawings, in which.

DETAILED DESCRIPTION OF THE INVENTION

Figure 1:
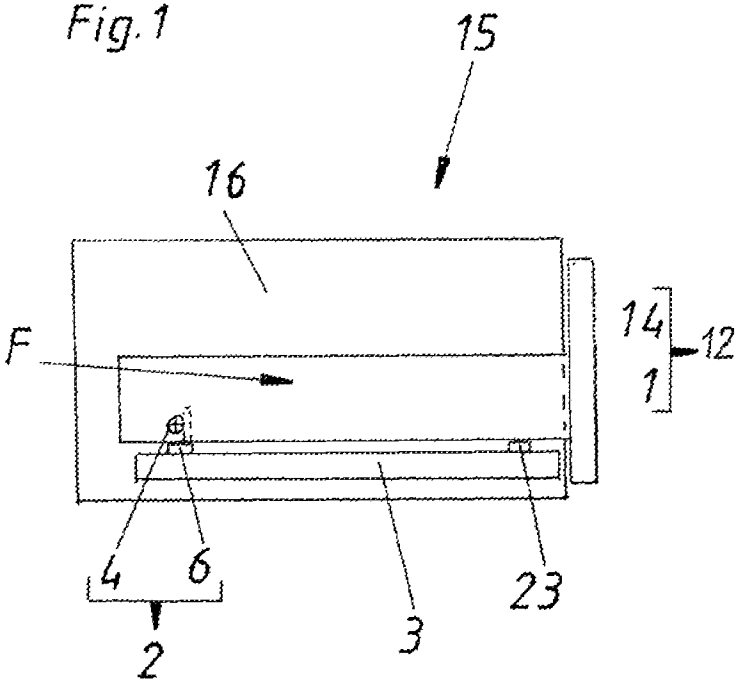
FIG. 1 shows a diagrammatic view of an inclination-adjustable drawer in the normal position.

FIG. 1 diagrammatically shows an article of furniture 15 including a furniture carcass 16, a drawer extension guide 3, and a drawer 2. A drawer frame member 1 and a front panel 14 of the drawer 12 can be seen. The drawer 12 is connected to the drawer extension guide 3 in the front region by way of a connecting location 23 (contact point). In the rear region, the drawer 12 or the drawer frame member 1 is connected to the drawer extension guide 3 by way of a support foot 6. The support foot 6 is part of an adjusting device 2 which has an actuating element 4 in the region of the inside surface F of the drawer frame member 1. That support foot 6 can rest on the drawer extension guide 3, preferably on its drawer rail 3, or can be fixedly connected thereto.

Figure 2:
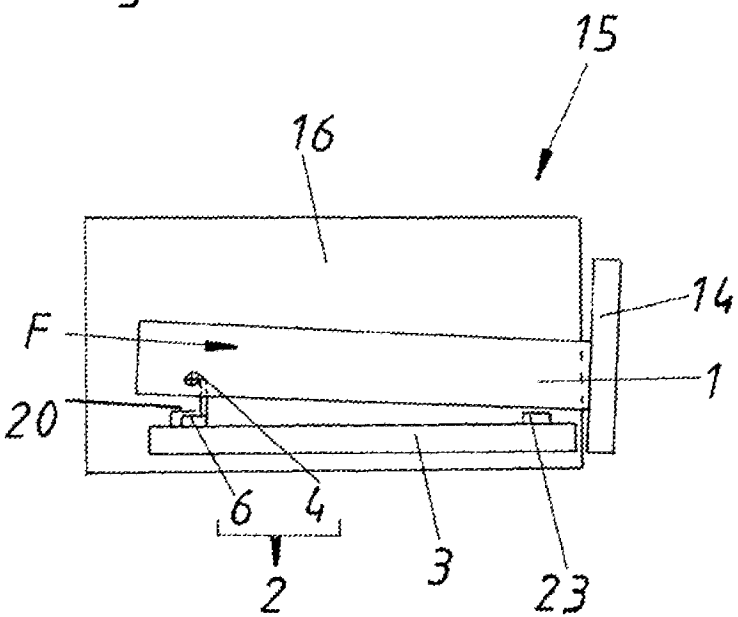
FIG. 2 shows a diagrammatic view of a drawer which is lifted in the rear region, with a front panel which is inclined thereby.

As diagrammatically shown in FIG. 2, actuation of the actuating element 4 triggers a relative movement of the actuating element 4 with drawer frame member 1 relative to the support foot 6, wherein the support foot 6 is held in positionally fixed relationship to the drawer extension guide 3 by way of a holding nose 20 of a drawer rail 19 of the extension guide 3. Depending on the direction in which actuation (preferably rotation) of the actuating element 4 is effected, the entire drawer 12 is raised and lowered and thereby pivoted about the front contact support point 23. That permits adjustment of the inclination of the front panel 14.

Figure 3:
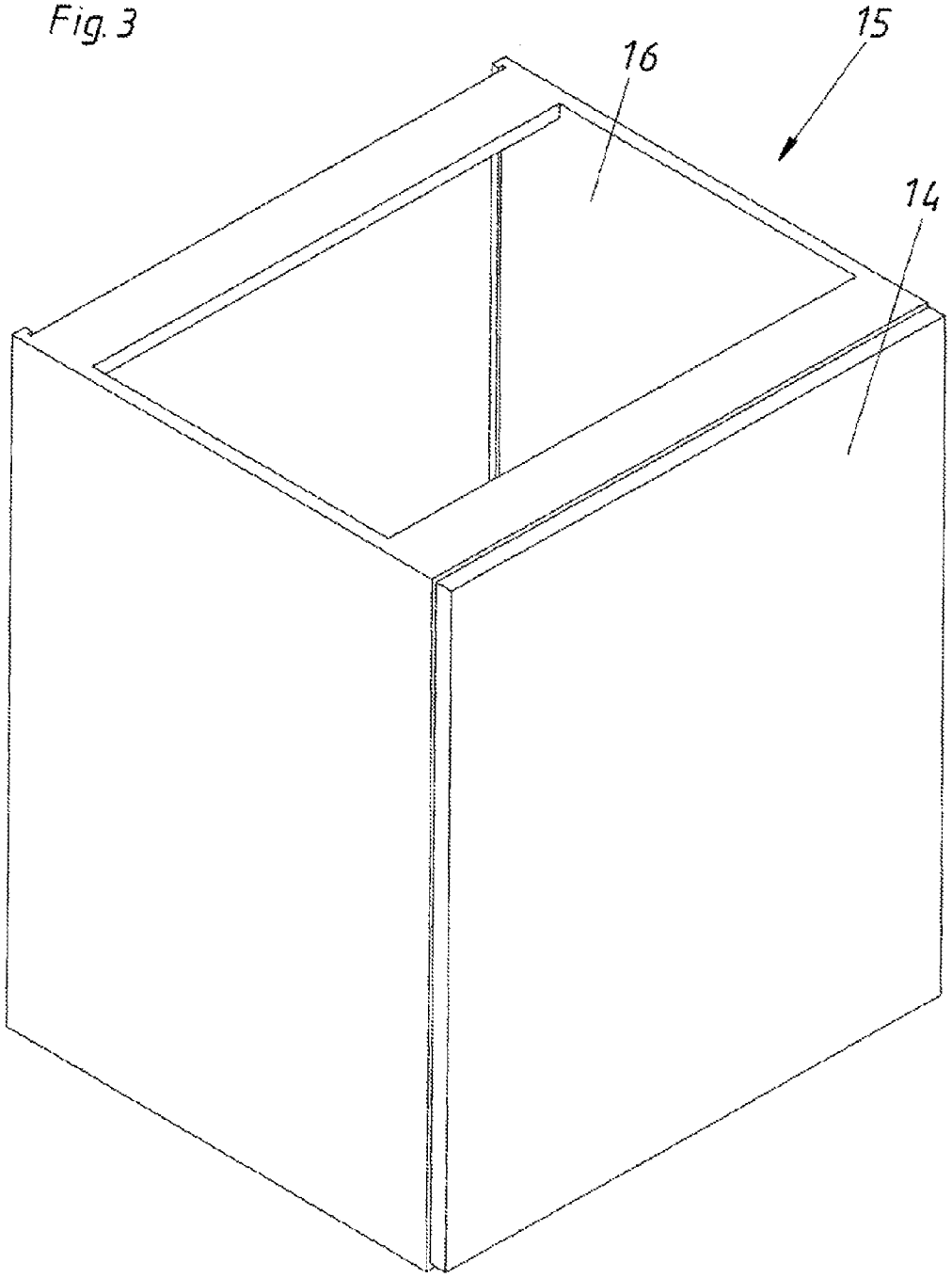
FIG. 3 shows a 3D view of an article of furniture.
Figure 4:
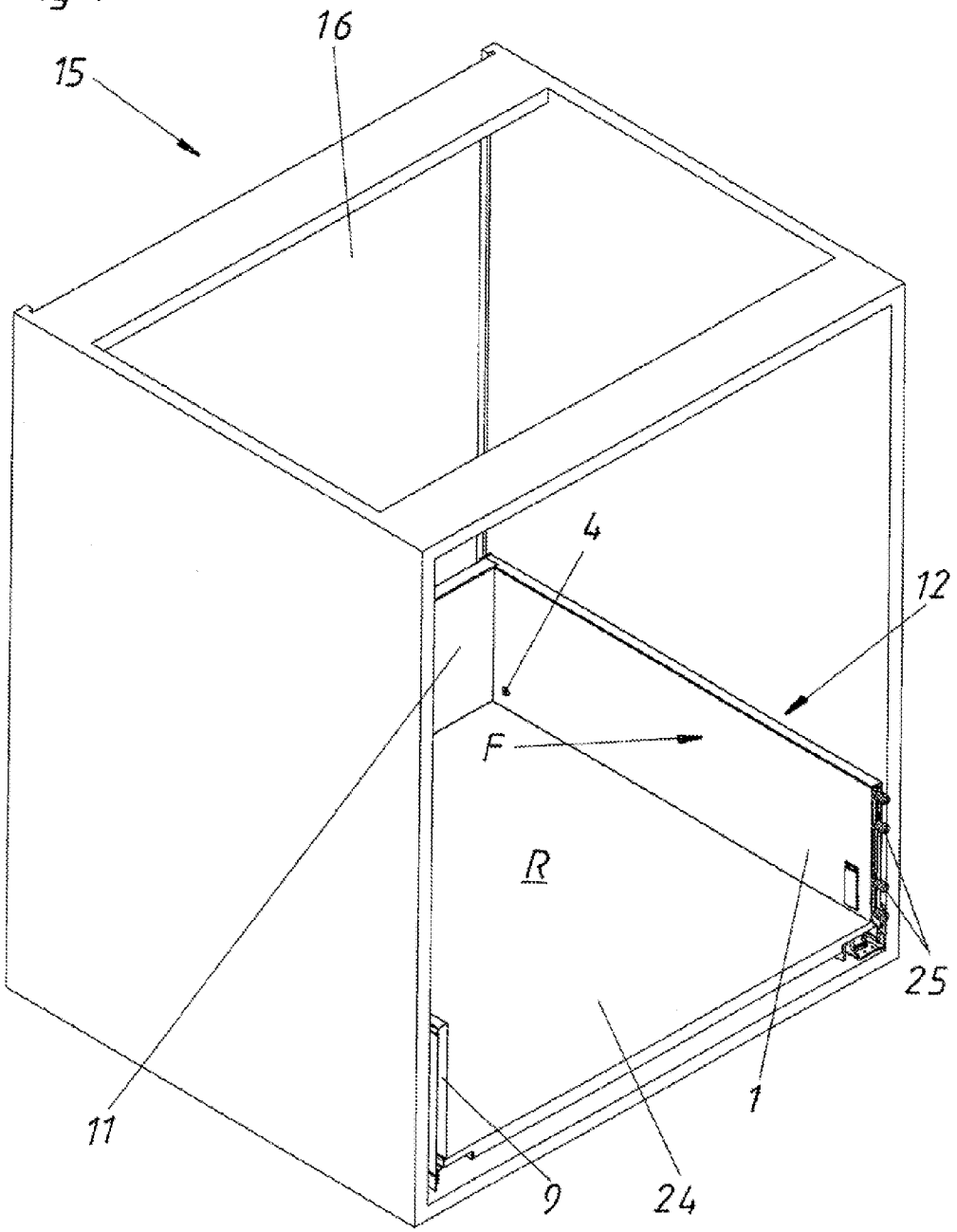
FIG. 4 shows a 3D view of the article of furniture without a front panel with a drawer.

FIG. 3 shows a 3D view of an article of furniture 15 having a furniture carcass 16 and a front panel 14. In comparison, FIG. 4 does not show the front panel 14 which can be fitted by way of the front panel fitment 25, thereby permitting a view of the remaining parts of the drawer 12. Besides the front panel 14 (not shown), that drawer 12 has two lateral drawer frame members 1, a rear wall 11 and a drawer bottom 24. That drawer 12 defines a drawer interior R, wherein the drawer interior R is laterally in turn delimited by the inside surfaces F of the drawer frame members 1. As can be seen in the left-hand region, the drawer frame member 1 has a preferably metal U-shaped profile member 9. In order now to provide for simple comfortable adjustment of the angle of inclination, it is provided according to the invention that the adjusting device 3 arranged substantially in the interior of the drawer frame member 1, in the region of the lateral inside surface F of the drawer frame member 1, that faces in the direction of the drawer interior R, has an actuating element 4 accessible from the drawer interior R. In that case, the actuating element 4 is preferably arranged in the rear region of the drawer 12 and is accessible and actuable through the U-shaped profile member 2 of the drawer frame member 1.

Figure 5:
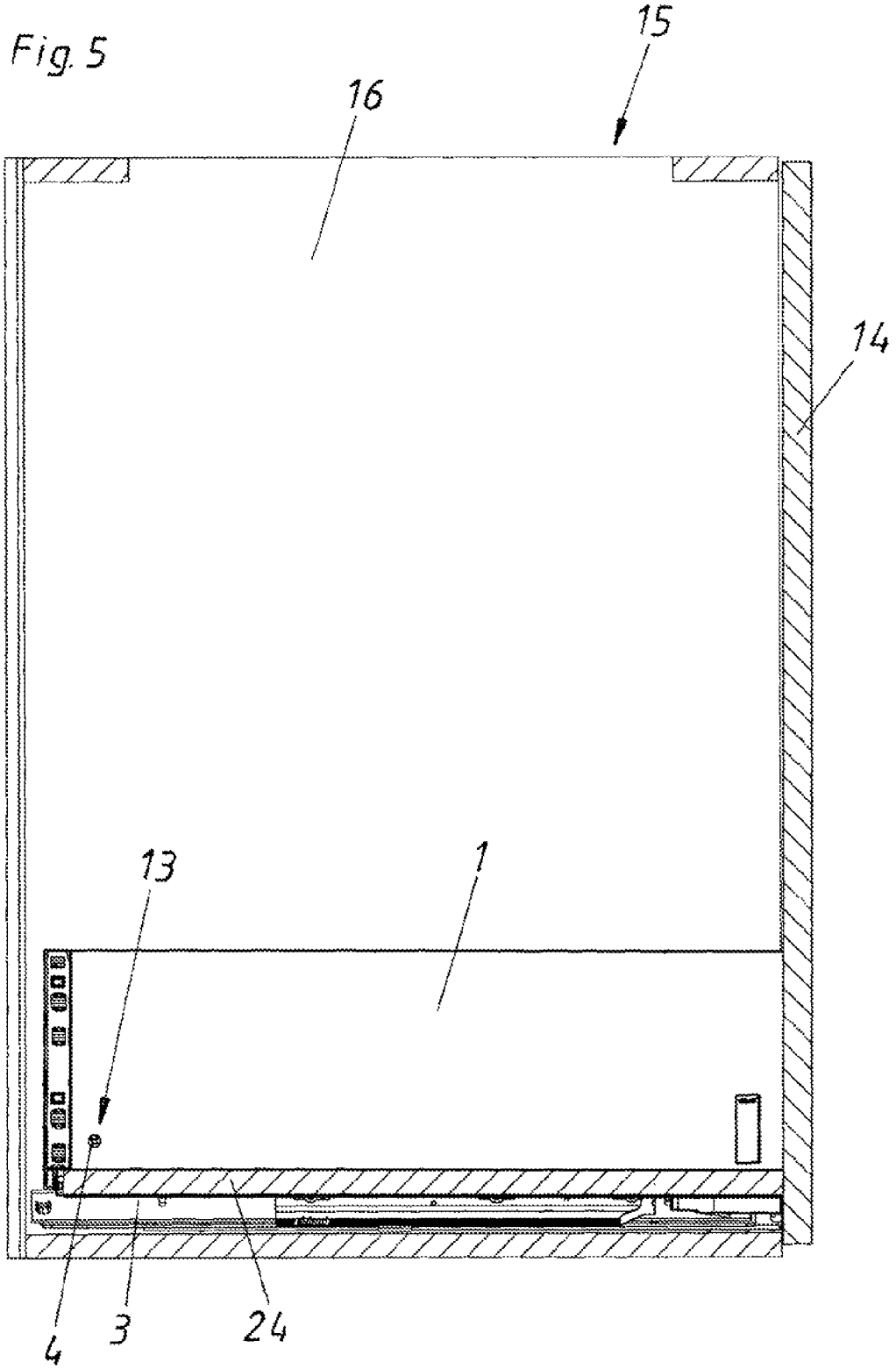
FIGS. 5 through 7 show sections through an article of furniture with different inclination positions of the front panel.
Figure 6:
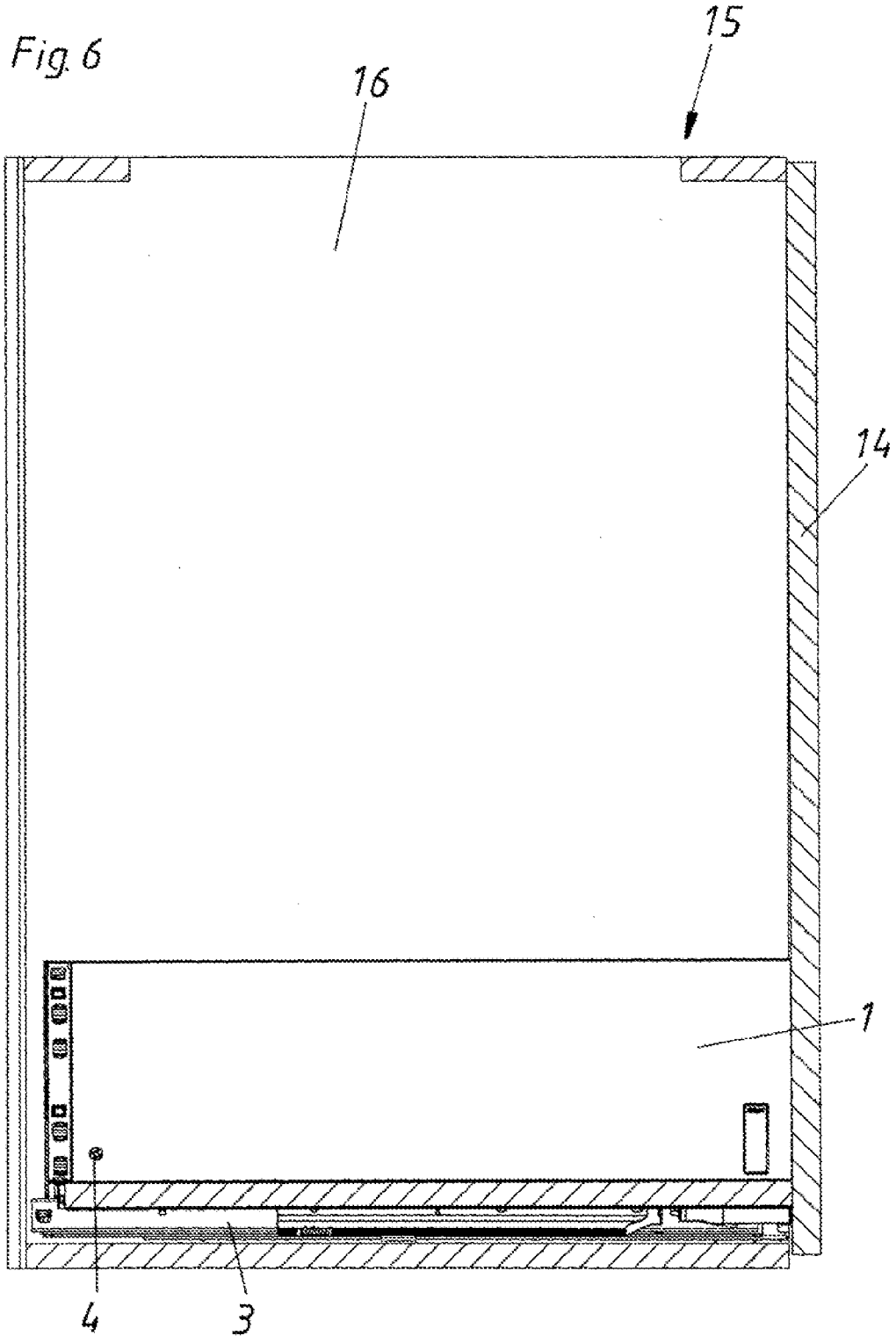
Figure 7:
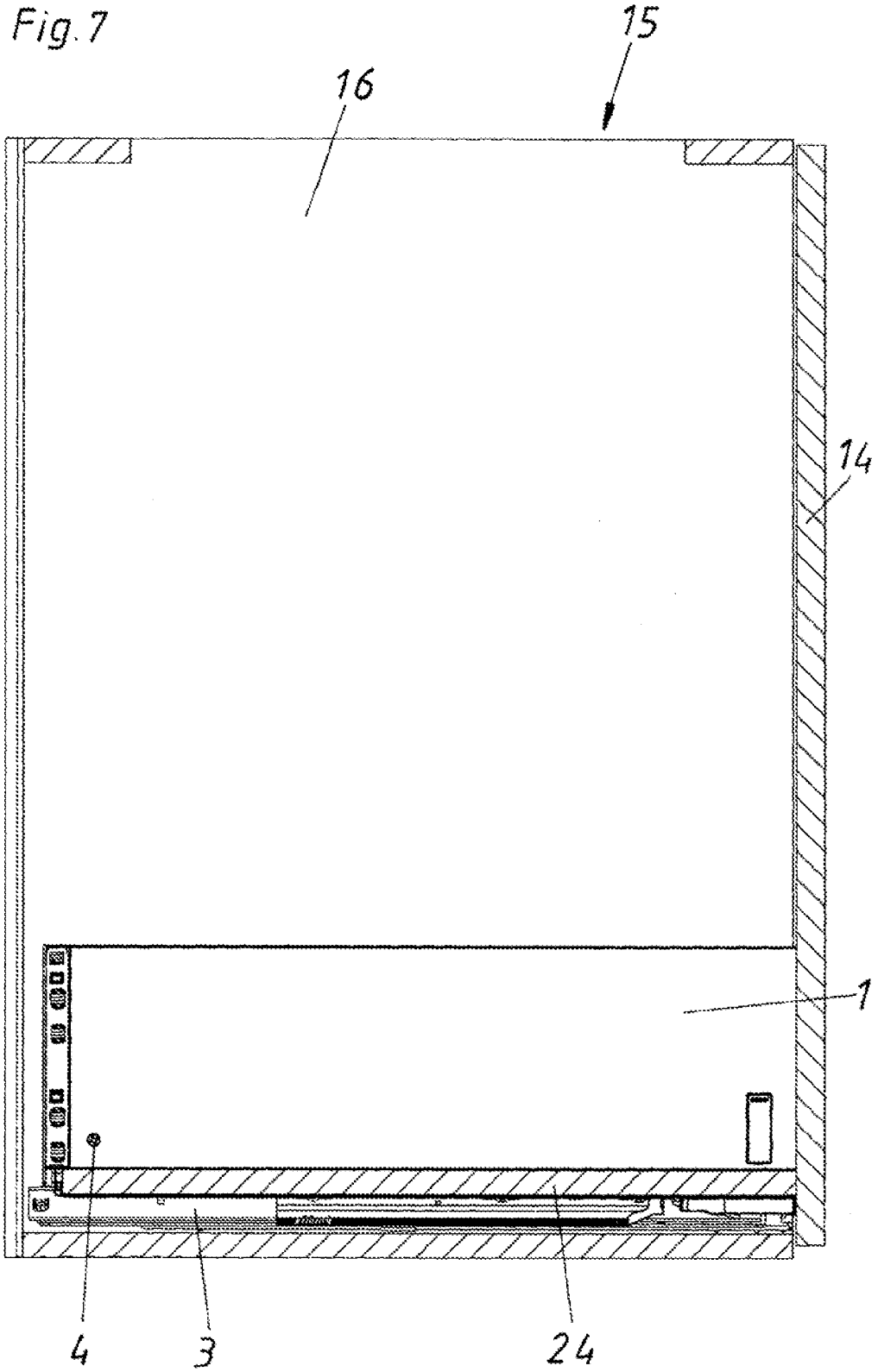

FIG. 5 shows the adjusting device 2 in the highest possible position, whereby the front panel 14 is tilted forwardly at the top. In contrast, FIG. 6 shows the furthest lowered position whereby the front panel 14 is moved back in the upper region or is inclined rearwardly. In FIG. 7, in contrast, the drawer 12 is oriented straight with respect to the furniture carcass 16.

Figure 8:
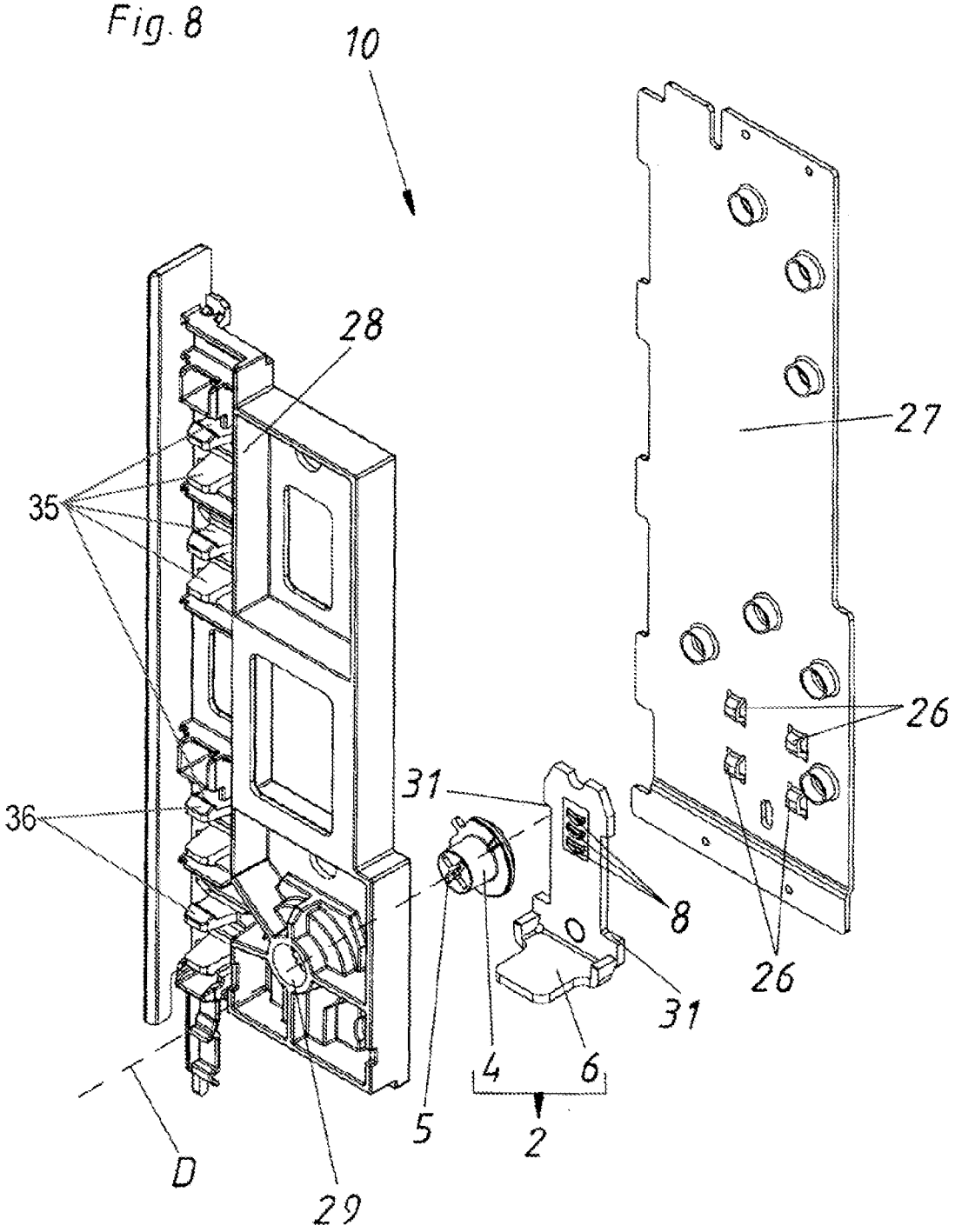
FIGS. 8 and 9 show exploded views of a rear wall holder with an adjusting device, FIGS. 10 and 11 each show an assembled rear wall holder with a support foot extended in different degrees.
Figure 9:
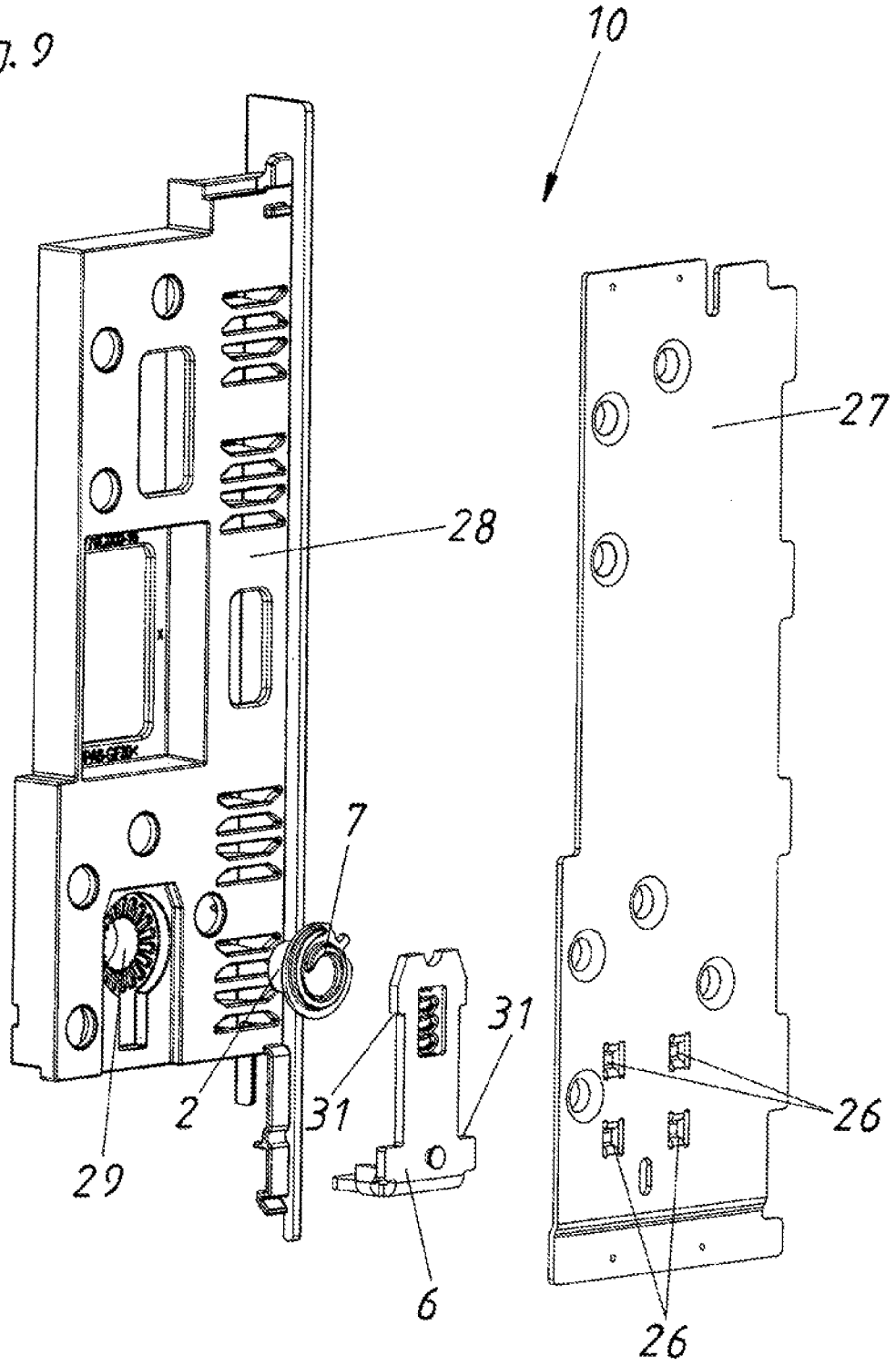

FIG. 8 shows a rear wall holder 10 which is part of a drawer frame member 1. The rear wall holder 10 has, on the one hand, a mounting plate 27 and a holding element 28 which can be connected to the mounting plate 27. The adjusting device 2 can be fitted between the holding element 28 and the mounting plate 27, the actuating element 4 of the adjusting device 2 being held in a round hole 29 in the holding element 28. The actuating element 4 can be actuated by a tool by way of a cross slot-shaped recess 25 and can be rotated about the axis of rotation D. Provided on the side of the actuating element 4, that is remote from the drawer interior R, is a spiral worm 7 (see FIG. 9) engaging into corresponding latching elements 8 on the support foot 6. Rotation of the actuating element 4 triggers a relative movement of the support foot 6 relative to the actuating element 4 and the mounting plate 27 and the holding element 28. In this case, that linear and vertical relative movement (heightwise movement) of the support foot 6 is laterally delimited by the guides 26 for the support foot 6. Abutments 31 for limiting movement upwardly and downwardly are in turn provided on the support foot 6.

Figure 10:
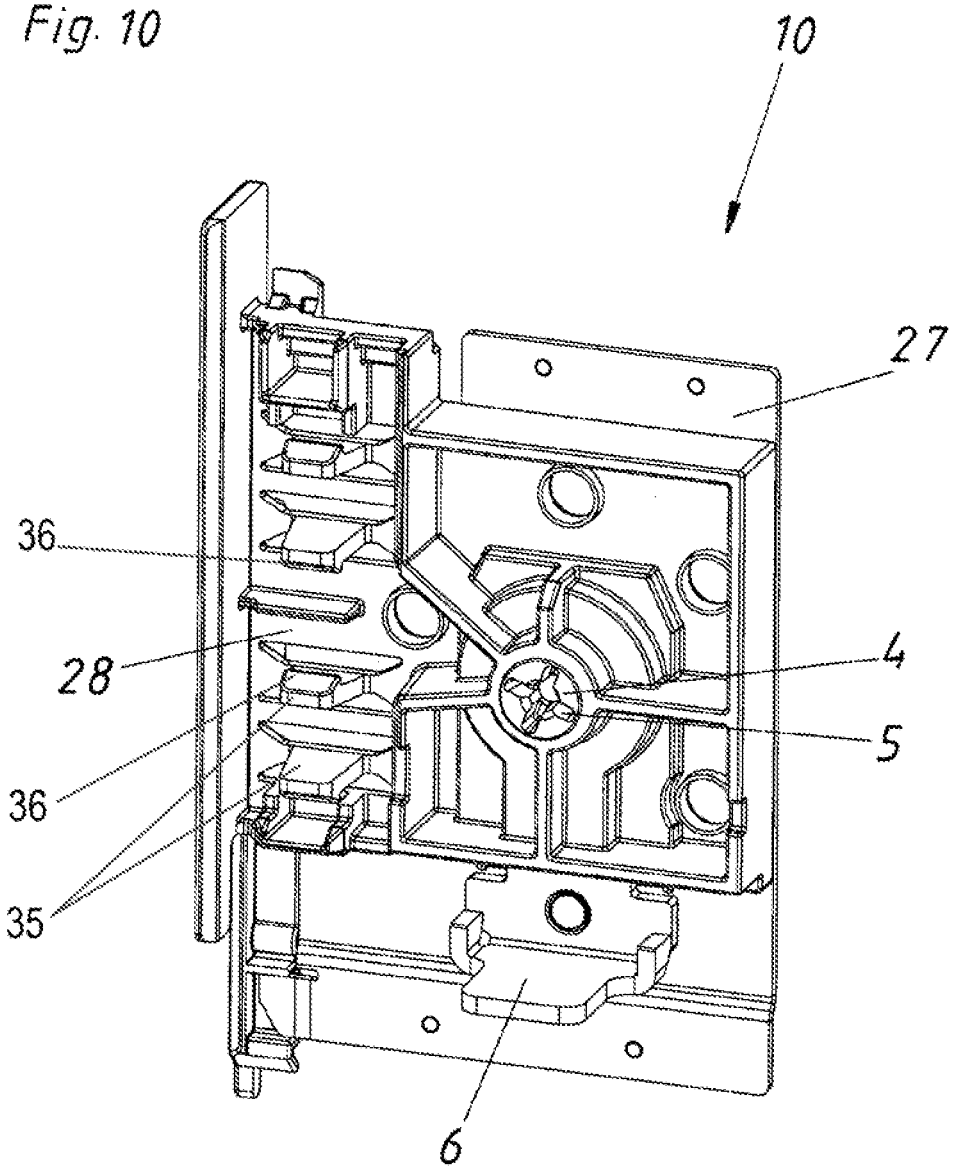

As also shown in FIG. 8, the holding element 28 has a plurality of resilient holding tabs 35 each having a respective catch nose 36 (see also FIG. 10). The holding tabs 35 attach the rear wall holder 10 to the rear wall 11 as explained below.

Figure 11:
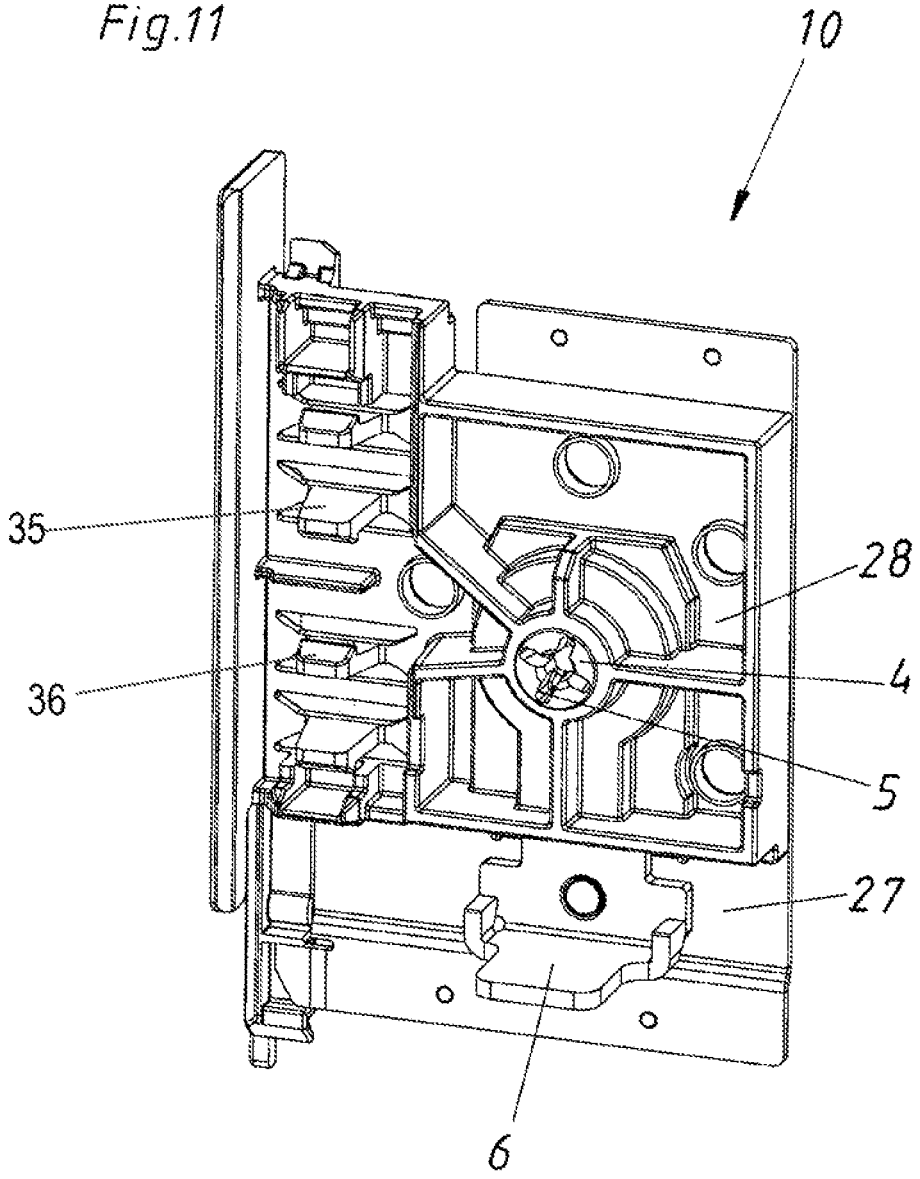

FIG. 10 shows the entire rear wall holder 10 in the assembled condition, wherein the actuating element 4 together with recess 5 terminates substantially flush with the holding element 28. The support foot 6 appears beneath the holding element 28. In comparison, in FIG. 11 the support foot 6 is extended downwardly by actuation of the actuating element 4.

Figure 12:
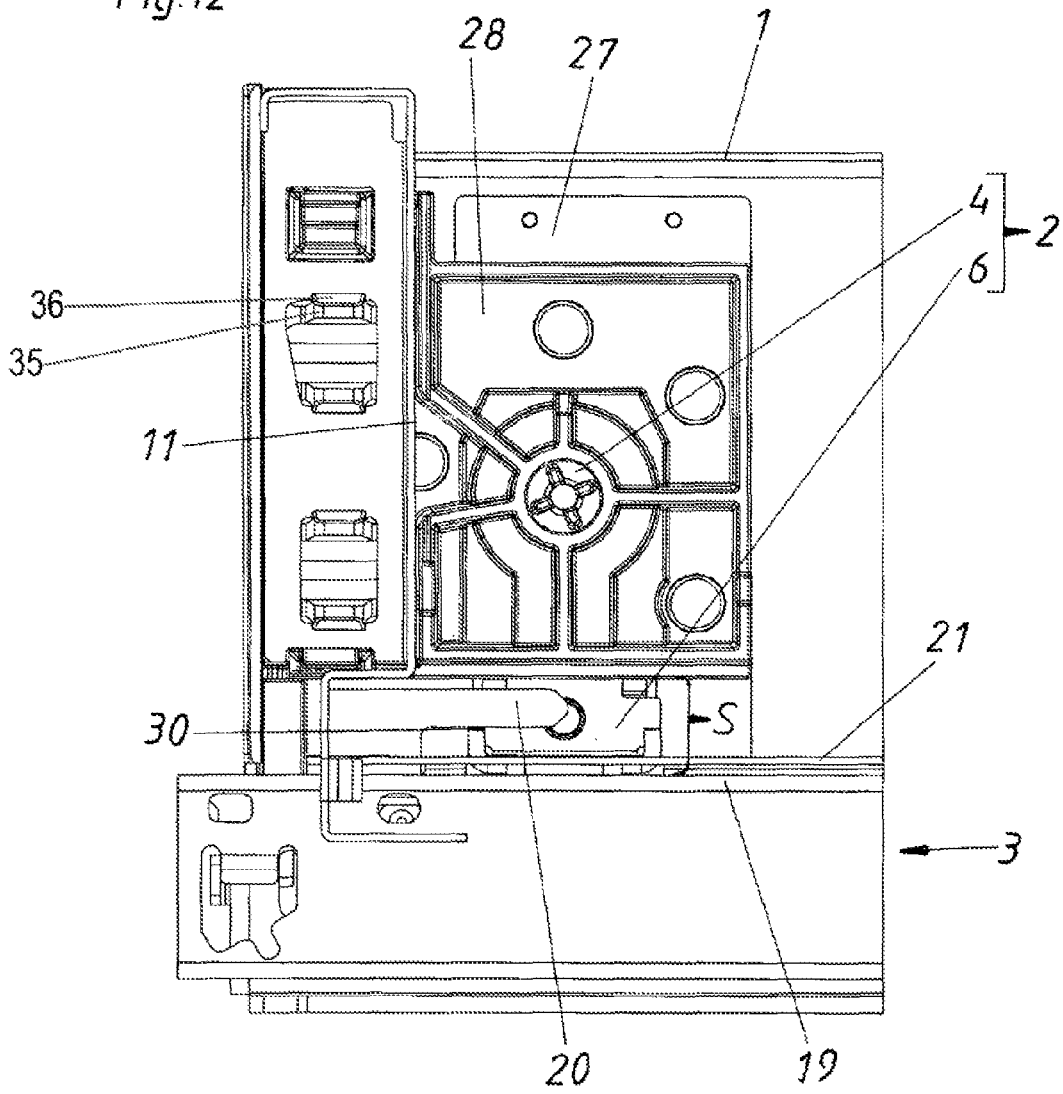
FIGS. 12 and 13 show sections through the lower region of a drawer frame member with differently set heights.
Figure 13:
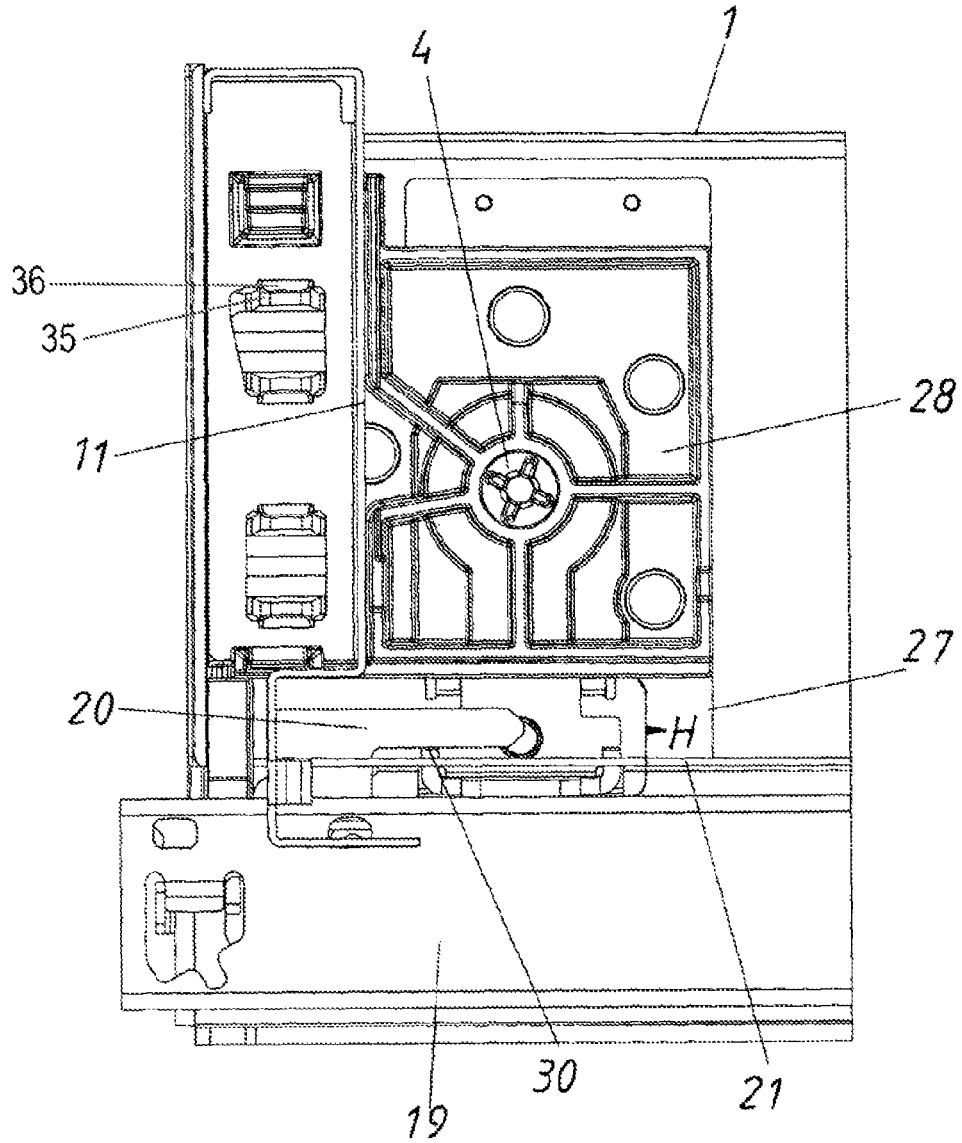

Correspondingly to FIG. 10, FIG. 12 shows a section through the rear wall holder with drawer frame member 1, rear wall 11 and drawer extension guide 3. In this case, the support foot 6 rests on the drawer rail 19 and is held in positionally fixed relationship in the vertical direction by the holding nose 20 of drawer rail 19 by way of the abutment region 30. The spacing between the rear wall holder 10 and the drawer rail 19 is the smallest possible lowered spacing S as shown in FIG. 12. In comparison, FIG. 13 corresponds to the view in FIG. 11 and shows the greatest possible raised spacing H between the rear wall holder 10 and the drawer rail 19. It will also be seen from those two FIGS. 12 and 13 that the container rail 21 which is arranged beneath the drawer bottom 24 and the drawer frame members 1, also moves with the entire drawer 12 in adjustment of the angle of inclination. As a result, the container rail 21 rests on the drawer rail 19 only when in the lowered position of the adjusting device 2.

FIGS. 12-16 also illustrate how the resilient holding tabs 35 attach the rear wall holder 10 to the rear wall 11. In particular, the holding tabs 35 are inserted into openings within the rear wall 11. Once inserted, each opposed pair of holding tabs 35 spring apart from each other within the same hole so that the catch noses 36 on the opposed pair of holding tabs 35 catch the inner surface of the rear wall 11 to hold the holding element 28 in place against the rear wall 11.

Figure 14:
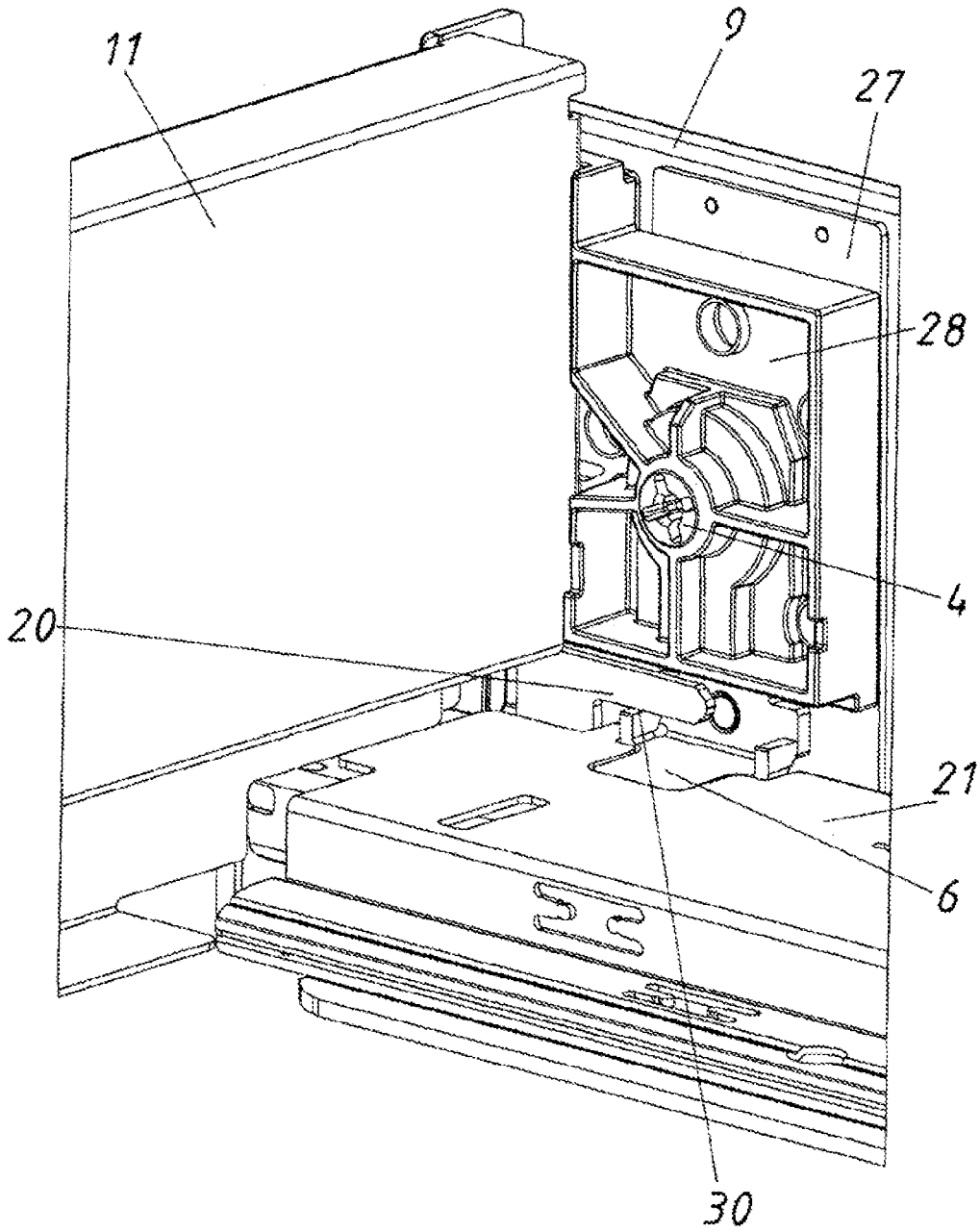
FIGS. 14 and 15 show 3D views corresponding to FIGS. 12 and 13.
Figure 15:
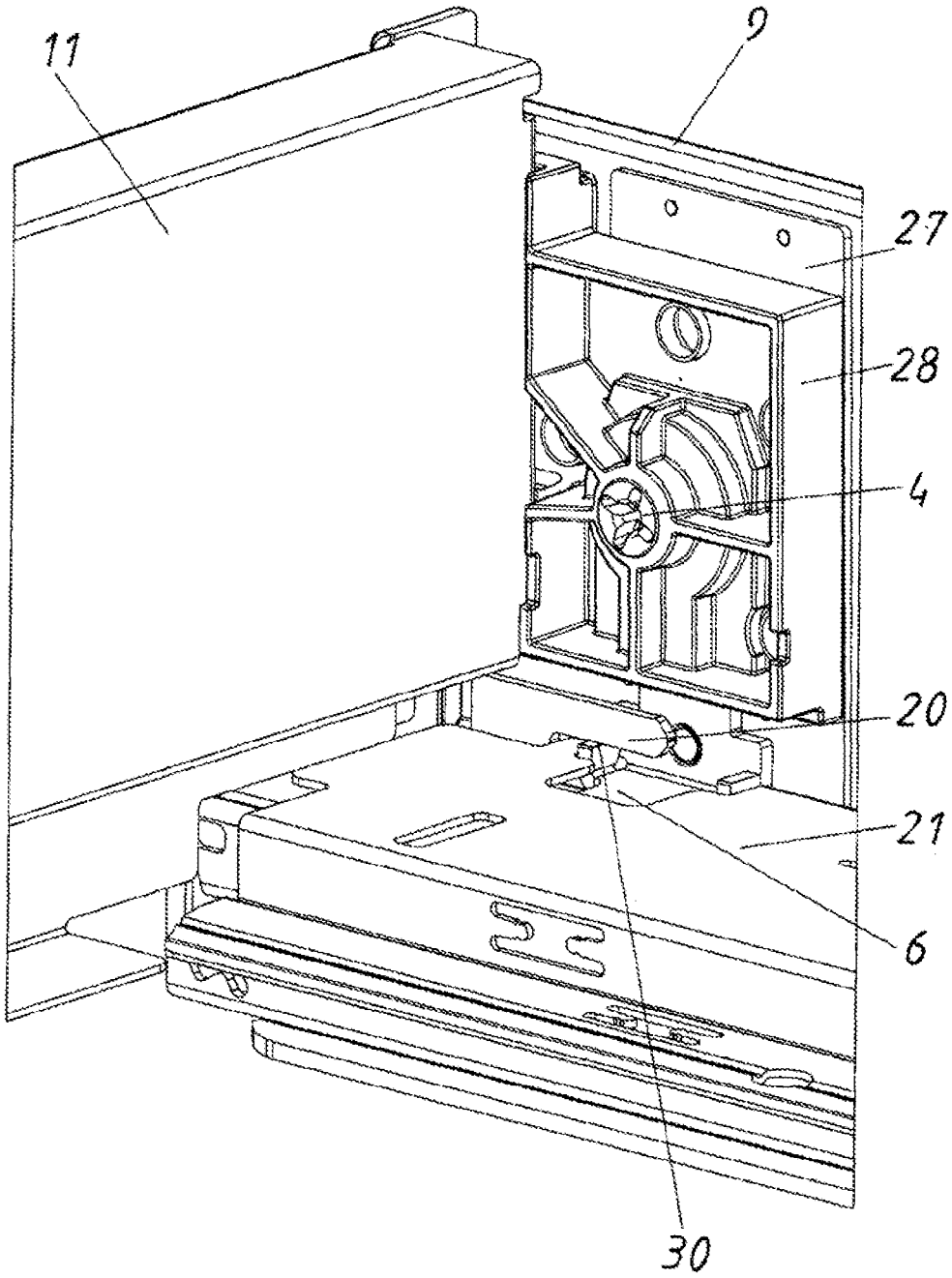

FIGS. 14 and 15 also show 3D views corresponding to the above-described positions, wherein the drawer bottom 24 and a part of the U-shaped profile member 9 are not shown here. FIG. 14 shows the lowered spacing S, the support foot 6 being disposed almost in one plane with the container rail 21. In comparison, FIG. 15 shows the raised spacing H at which the container rail 21 connected to the drawer frame member 1 (and thus the entire drawer 12) is raised relative to the support foot 6 and relative to the drawer rail 19.

Figure 16:
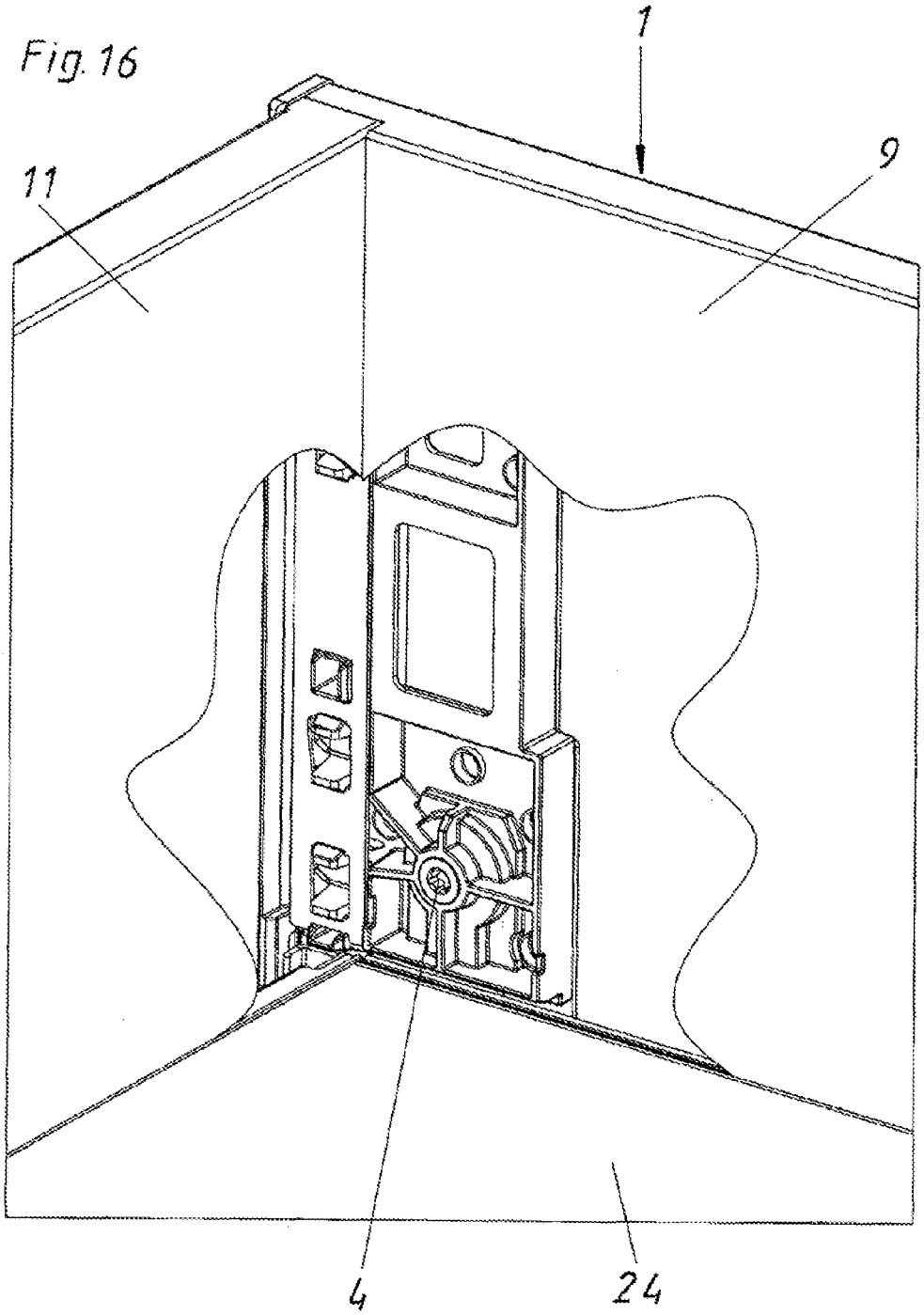
FIG. 16 shows a partly broken-away 3D view of the rear region of a drawer.

FIG. 16 shows a partly broken-away view of the rear region of the drawer 12, thereby permitting a view on to a part of the rear wall holder 10 with actuating element 4. The recess in the actuating element 4 is in the form of a hexagonal socket in FIG. 16.

Figure 17:
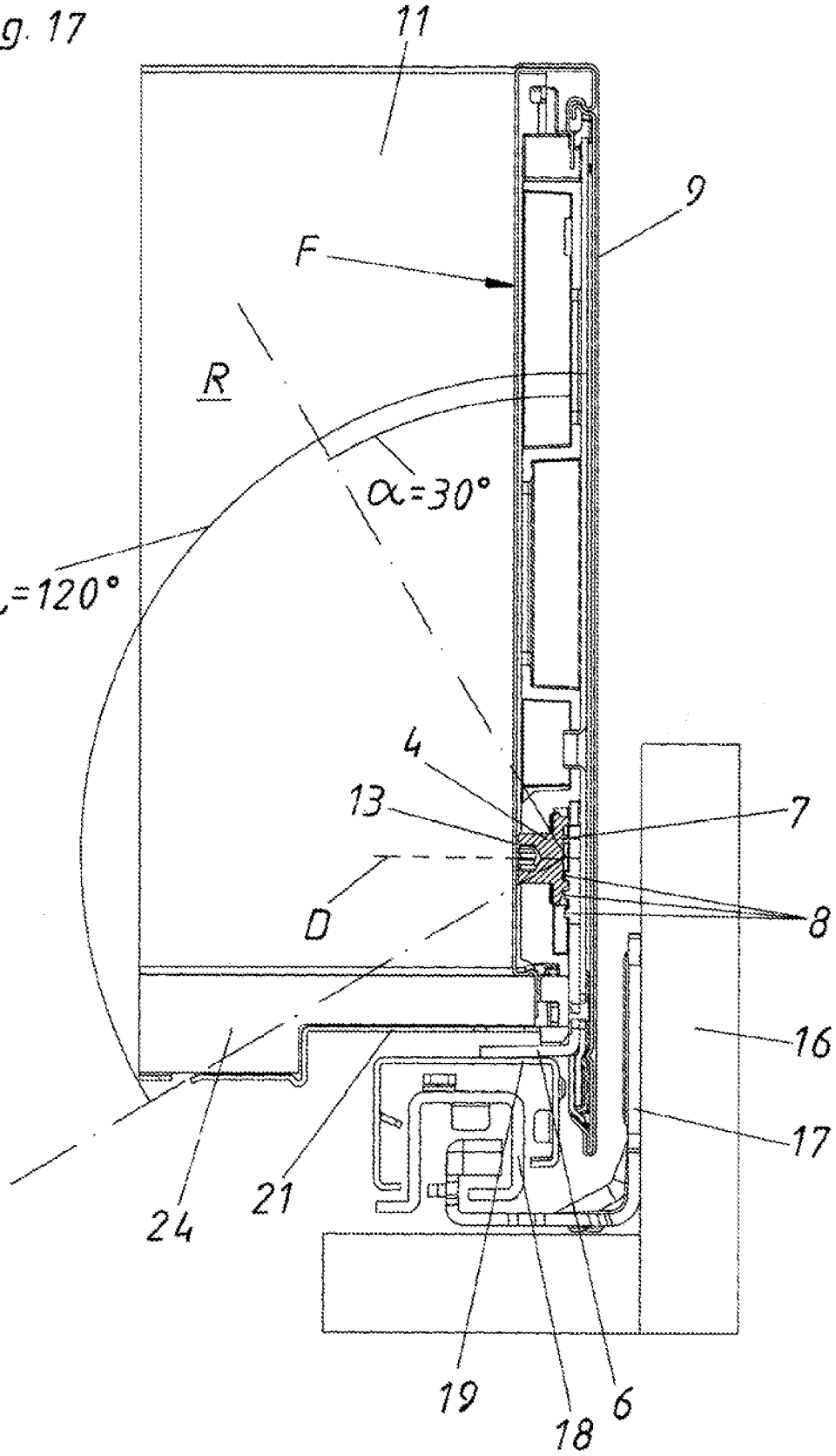
FIGS. 17 and 18 shows sections parallel to the front panel through the drawer frame member with adjusting device set to different heights.
Figure 18:
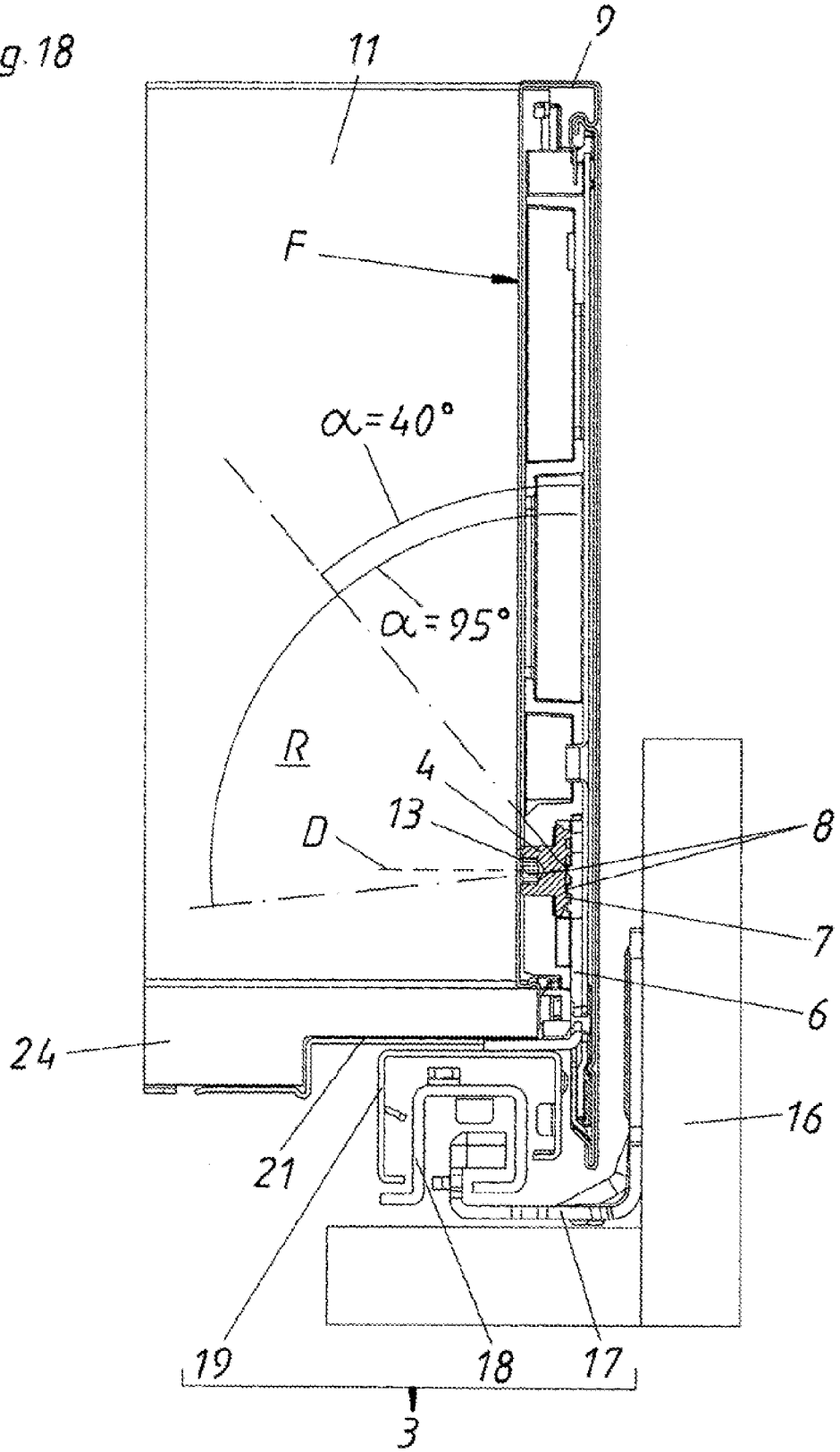

FIGS. 17 and 18 show a view in section through the drawer frame member 1 and the drawer extension guide 3 parallel to the front panel. The drawer extension guide 3 is fixed to the furniture carcass 16 by way of the carcass rail 17. In addition, the drawer extension guide 3 has a central rail 18 and a drawer rail 19. The support foot 6 of the adjusting device 2 bears on (engages) that drawer rail 19. As also shown in FIG. 8, the support foot 6 of adjusting device 2 has a plurality of latching elements 8 which correspond to the spiral worm 7 of the actuating element 4, and the spiral worm 7 engages into the recesses between the latching elements 8. The extension movement of the support foot 6 is produced by rotation of the actuating element 4 about the axis of rotation D. As can be clearly seen from FIGS. 17 and 18, the actuating element 4 can be easily reached by a fitter, by way of the drawer interior R. It will be noted, however, that the axis of rotation D of the actuating element 4 does not have to be horizontal but can be inclined in an angular range of between 30° and 120° relative to the vertical orientation of the inside surface F of the drawer frame member 1. FIG. 18 shows a smaller still more preferred range of the angle $\alpha$ of between 40° and 95°. In addition FIG. 18 again shows the drawer frame member 1 in the lowest lowered position (spacing S), wherein the latching elements 8 engage correspondingly further upwardly in the raised portions 7 of the actuating element 4, that are in the form of the spiral worm. FIGS. 17 and 18 show the hole 13 in the U-shaped profile member 9 for better accessibility to the actuating element 4.

The invention claimed is:

1. A drawer frame comprising:

a drawer frame member having a U-shaped profile and a lateral inside surface facing towards an interior of said drawer frame; and an adjusting device for raising and lowering said drawer frame member relative to a drawer extension guide, said adjusting device being arranged in an interior of said drawer frame member and having an actuating element accessible from said interior of said drawer frame through the lateral inside surface of said drawer frame member;

wherein said drawer frame member includes a rear wall holder connected to said U-shaped drawer frame member for connecting said drawer frame member to a rear wall of a drawer, said adjusting device being a component of said rear wall holder.

2. The drawer frame as set forth in claim 1, wherein said lateral inside surface extends substantially vertically in a mounted position of said drawer frame member.

3. The drawer frame as set forth in claim 2, wherein an axis of rotation of said actuating element extends transversely relative to the substantially vertical orientation of said lateral inside surface.

4. The drawer frame as set forth in claim 3, wherein said axis of rotation is at an angle of between 40° and 95° in relation to the substantially vertical orientation of said lateral inside surface.

5. The drawer frame as set forth in claim 1, wherein said actuating element is rotatable.

6. The drawer frame as set forth in claim 5, wherein said rotatable actuating element has a surface facing towards said interior of said drawer frame, and has a recess in said surface for receiving a tool.

7. The drawer frame as set forth in claim 1, wherein said adjusting device has a support foot configured to rest on the drawer extension guide in a mounted position, said support foot being moveable linearly and vertically by actuation of said actuating element.

8. The drawer frame as set forth in claim 7, wherein said actuating element has a spiral worm at an end thereof remote from said interior of said drawer frame, and said spiral worm engages corresponding latching elements on said support foot.

9. The drawer frame as set forth in claim 1, wherein said U-shaped drawer frame member has a hole through which said actuating element of said adjusting device is accessible.

10. The drawer frame as set forth in claim 1, wherein said adjusting device is located within said rear wall holder.

11. The drawer frame as set forth in claim 1, wherein said rear wall holder comprises a mounting plate and a holding element mounted to said mounting plate, said adjusting device being located between said mounting plate and said holding element.

* * * * *